US012345465B2

(12) United States Patent
Bianchezzi et al.

(10) Patent No.: US 12,345,465 B2
(45) Date of Patent: Jul. 1, 2025

(54) REFRIGERATOR APPLIANCE SHELVING SYSTEM

(71) Applicant: WHIRLPOOL CORPORATION, Benton Harbor, MI (US)

(72) Inventors: Vinicius Bianchezzi, Joinville (BR); Arthur Sady Abreu Marcon, St. Joseph, MI (US); Ualisson Ferreira Da Silva, Joinville (BR); Gustavo Spezzia, Joinville (BR); Matheus Zappelini, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 100 days.

(21) Appl. No.: 18/191,539

(22) Filed: Mar. 28, 2023

(65) Prior Publication Data

US 2024/0328706 A1 Oct. 3, 2024

(51) Int. Cl.
*F25D 25/02* (2006.01)
*F25D 23/06* (2006.01)

(52) U.S. Cl.
CPC ..... *F25D 25/02* (2013.01); *F25D 23/067* (2013.01); *F25D 2325/021* (2013.01)

(58) Field of Classification Search
CPC . A47B 57/42; A47B 57/425; F25D 2325/021; F25D 23/067; F25D 25/02
See application file for complete search history.

(56) References Cited

U.S. PATENT DOCUMENTS

| | | | | |
|---|---|---|---|---|
| 3,707,317 | A * | 12/1972 | Dawley | F25D 25/02 312/408 |
| 5,486,045 | A * | 1/1996 | Dasher | A47B 57/06 248/300 |
| 7,299,651 | B2 | 11/2007 | Oh | |
| 10,697,689 | B2 | 6/2020 | Lindel et al. | |
| 2009/0302726 | A1* | 12/2009 | Eckartsberg | F25D 23/067 29/700 |
| 2013/0106274 | A1* | 5/2013 | Yang | F25D 25/02 312/405.1 |
| 2018/0164029 | A1 | 6/2018 | Lindel et al. | |
| 2020/0288866 | A1* | 9/2020 | Richard | A47B 96/06 |
| 2021/0055043 | A1* | 2/2021 | Wantland | H01R 25/162 |

FOREIGN PATENT DOCUMENTS

KR 20140131758 A 11/2014

* cited by examiner

*Primary Examiner* — Matthew W Ing
(74) *Attorney, Agent, or Firm* — Brooks Kushman P.C.

(57) ABSTRACT

A refrigerator appliance includes a liner defining a compartment and having a back wall. An elongate shelf-support ladder has a web with a first attachment feature. The ladder is attached to the back wall with the web spaced from the interior side. A shelf-support arm has a second attachment feature attached to the first attachment feature of the web such that the arm cantilevers from a front face of the web. A portion of the second attachment feature extends through the web and is received in a space defined between the web and the interior side. A shelf is supported by the arm.

18 Claims, 5 Drawing Sheets

REFRIGERATOR APPLIANCE SHELVING SYSTEM

TECHNICAL FIELD

This disclosure relates to refrigerator appliances and more particularly to shelving systems of the refrigerator appliances.

BACKGROUND

In order to keep food fresh, a low temperature must be maintained within a refrigerator to reduce the reproduction rate of bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

According to one embodiment, a refrigerator appliance includes a liner defining a compartment and having a back wall. An air duct is disposed against an interior side of the back wall and defines a first vertical slot. A cover is supported by the back wall and is disposed over the air duct. The cover defines a second vertical slot aligned with the first slot. An elongate shelf-support ladder has a web with a first attachment feature, wherein the ladder is received in the first and second vertical slots and is attached to the back wall with the web spaced from the interior side. A shelf-support arm has a second attachment feature attached to the first attachment feature of the web such that the arm cantilevers from a front face of the web. A portion of the second attachment feature extends through the web and is received in a space defined between the web and the interior side. A shelf is supported by the arm.

The ladder may include first and second sides extending forwardly from the web. The central arm may be disposed between the first and second sides when connected to the ladder. The ladder may include a tapered entrance to facilitate connection of the arm to the ladder. The tapered entrance may be formed by flaring portion of the of first and second sides away from each other.

In one or more embodiments, the first and second sides of the ladder may extend rearwardly from the web to engage with the interior side of the back wall. A width between the first and second sides may be wider on a rear side of the web than on a front side of the web.

Alternatively, a spacer may be disposed between the web and the interior side of the back wall. Here, the spacer inhibits the ladder from contacting the back wall. The spacer may be centered on the web between the sidewalls of the ladder. The spacer may define opening configured to receive a fastener therethrough. The fastener may extend through a hole provided in the ladder. The fastener extends through the ladder, the spacer, the back wall, and is received in another fastener. The fasteners may be threaded. For example, fastener may be a screw and the another fastener may be a nut. The nut may be referred to as an anchor and may include wings for engaging with insulation to ensure a secure fit in the final assembly. The spacer may be provided as part of a fastener assembly.

According to another embodiment, a refrigerator appliance includes a liner having a back wall with interior and exterior sides. a shelving system of the refrigerator includes an elongate shelf-support ladder and a fastener assembly attaching the ladder to the back wall. The fastening assembly has (i) a spacer disposed between the ladder and the interior side of the back wall, (ii) an anchor on the exterior side of the back wall, and (iii) a fastener extending through the ladder, the spacer, the liner, and the anchor.

The refrigerator appliance may further include an air duct disposed against the interior side of the back wall and defining a first slot and a cover mounted on the back wall and disposed over the air duct. The cover may define a second slot aligned with the first slot, and the ladder may be received in the first and second slots. The spacer may also be received in the first and second slots.

The shelving system may include a central arm having a rear portion attached to the ladder such that the arm is cantilevered from the ladder and a shelf supported by the central arm. The ladder may define holes that receive attachments of the rear portion therein such that the attachments extend from a back side of the ladder towards the back wall, Here, the spacer is disposed between the attachments. The attachments may be hooks.

A thickness of the spacer may be greater than projecting lengths of the attachments so that tips of the attachments are spaced from the interior side of the back wall. The spacer may define a pair of side-by-side fastener holes that receive two fasteners extending through the fastener holes. The spacer may have a first side disposed against the ladder and a second side disposed against the back wall. A surface area of the first side may be larger than a surface area of the second side.

According to yet another embodiment, a refrigerator appliance includes a liner having a back wall and an elongate shelf-support ladder mounted to the liner. The ladder includes a pair of opposing first and second sidewalls spaced from each other and a web extending from the first sidewall to the second sidewall to connect the first and second side walls to each other. The sidewalls are oriented substantially orthogonal to the web such that front portions of the first and second sidewalls project from a front face of the web and such that rear portions of the first and second sidewalls project from a rear face of the web. The ladder is attached to the back wall of the liner with the rear portions disposed against the back wall to define a pocket bounded by the liner, the sidewalls, and the web. A shelf-support arm is disposed between the first and second sidewalls and connected to the web such that the arm cantilevers from the front face. A portion of the arm extends through the web and is received in the pocket. A shelf supported by the arm.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
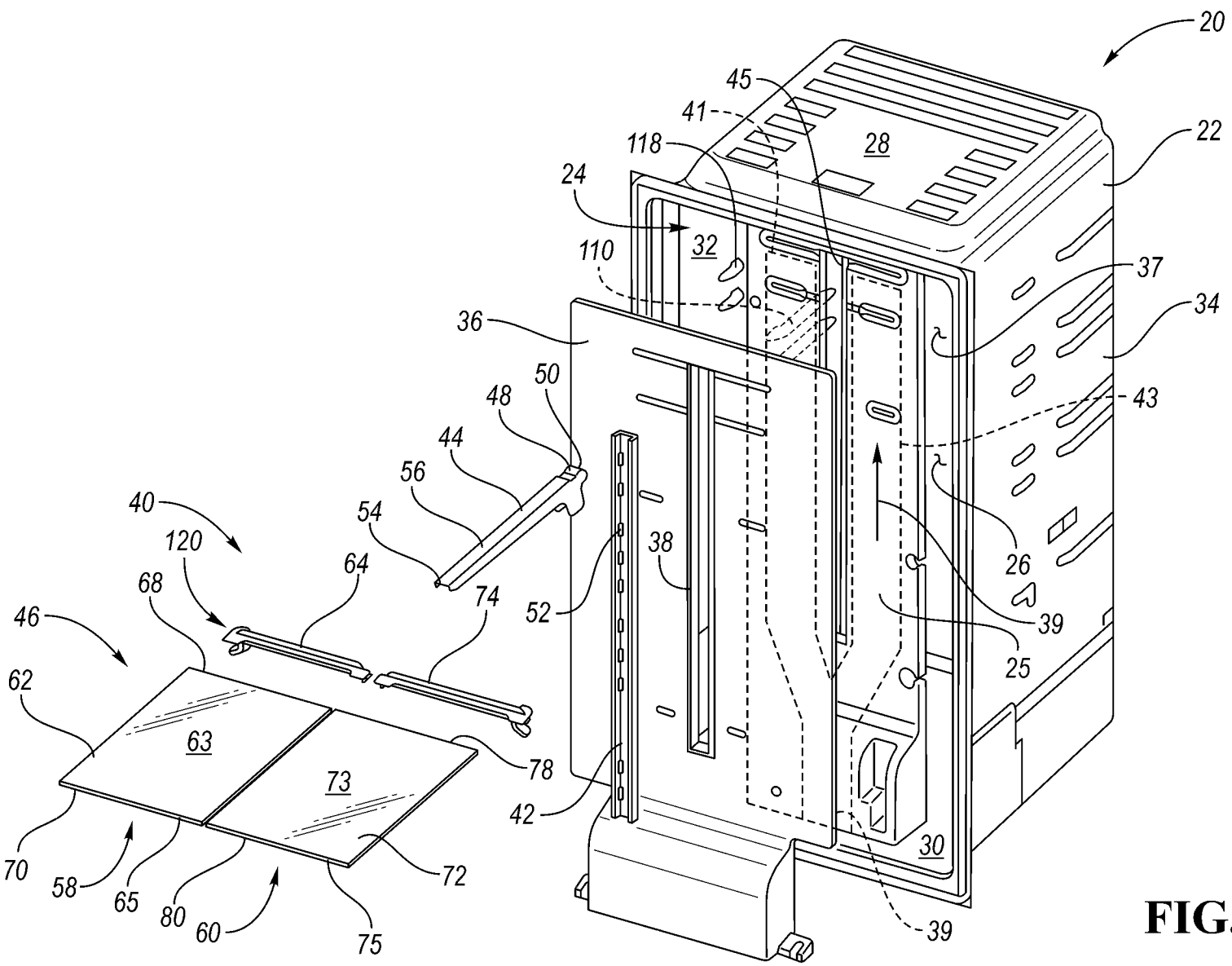
FIG. 1 is an exploded perspective view of a refrigerator appliance.
Figure 2:
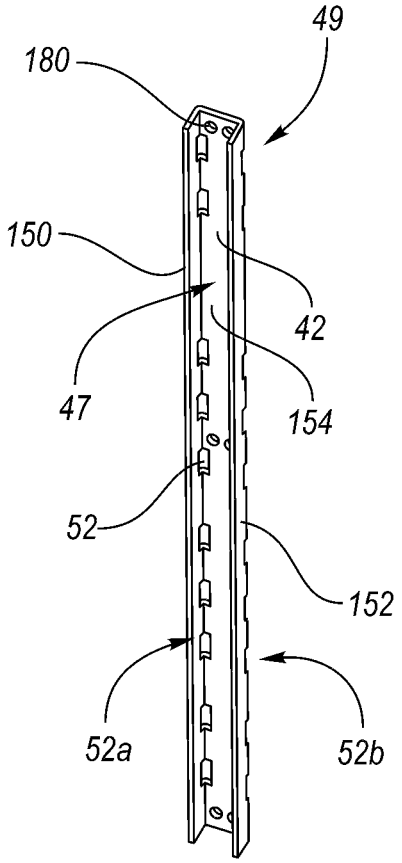
FIG. 2 is a perspective view of a support ladder of the shelving system.

Referring to FIGS. 1 and 2, a refrigerator appliance 20 includes an outer housing or cabinet (not shown) that forms the exterior of the appliance 20. Within the cabinet are one or more compartments or cavities such as a fresh-food compartment 24 and a freezer compartment. The refrigerator appliance 20 may include one or more liners that define the compartments. For example, a liner 22 defines the fresh-food compartment 24. The liner 22 includes a back wall 26, a top wall 28, a bottom wall 30, and opposing first and second sidewalls 32 and 34 that cooperate to define the compartment or cavity 24. While not shown, a second liner may be used to form the freezer compartment. The freezer compartment may be disposed above or below the fresh-food compartment 24. In one embodiment, the refrigerator appliance 20 is a so-called "French-style refrigerator" having the fresh-food compartment 24 on top and the freezer compartment below. One or more doors (not shown) are attached to the cabinet to seal the one or more compartments.

The refrigerator 20 includes an air-circulation system that operates in conjunction with a refrigerant system (not shown) to cool the compartment 24. The air-circulation system may include an air duct 25 and a cover 36. The air duct 25 defines channeling on the backside and is attached to the interior side 37 of the back wall 26 such that an air path 39 is formed. The air path 39 may be generally Y-shaped and having left and right branches 41 and 43 on opposing sides of a central slot 45.

A cover 36 is disposed over the air duct 25 and may be attached to the interior side 37 of the back wall 26 of the liner 22 or to the air duct 25. The cover 36 may define a vertical slot 38 centered on the back wall 26 such that a first distance between the first sidewall and the slot 38 is substantially equal to a second distance between the second sidewall and the slot 38. Herein, substantially equal means within 5 percent. (The slot 45 may also be substantially centered on the back wall 26.) The slot 38 may be sized and shaped to align with the slot 45 as shown in the illustrated example. Additional openings may be provided in the cover 36 in addition to the vertical slot 38. Of course, other types of air-circulation systems are contemplated, and this disclosure is not limited to the illustrated system. For example, the cover and air duct may be implemented as a single component attached to the back wall. Alternatively, the ducts may be provided at other areas of the refrigeration component.

The refrigerator appliance 20 has a shelving system 40 configured to support food items stored within the fresh-food compartment 24. The shelving system 40 may include an elongate shelf-support ladder 42 arranged vertically on the back wall 24 and positioned centrally. The support ladder 42 may be received in the slots 38 and 45 and secured to the liner 22 by fasteners or other assemblies as will be discussed in more detail below. The ladder 42 forms the backbone of the shelving system 40 and is a main structural component. One or more shelf assemblies 46 of the system 40 are supported by the ladder 42. The ladder 42 has a front face 47 and a rear face 49.

Figure 3:
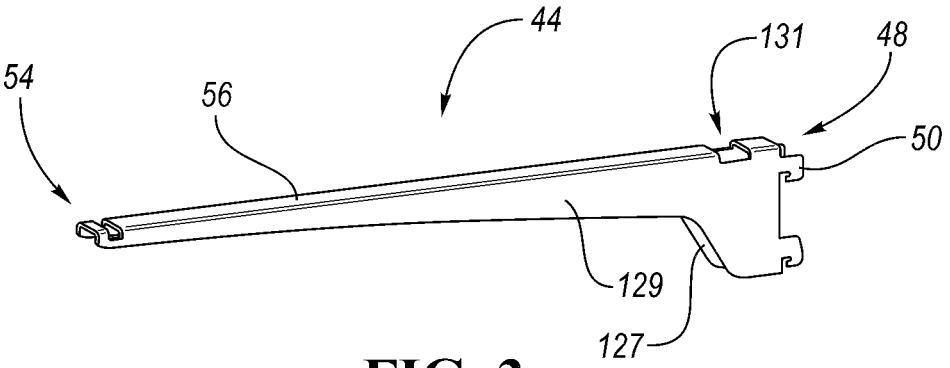
FIG. 3 is a perspective view of a central support arm of a shelving system.

Referring to FIGS. 1-3, each shelf assembly 46 may include a central support arm 44 attached to the support ladder 42. The central arm 44 has a rear portion 48 configured to connect with the ladder 42. The rear portion 48 may include attachment features 50, e.g., hooks, configured to engage with attachment features 52, e.g., slots or openings, of the ladder 42. The arm 44 may be designed to only attach at the rear portion 48 and cantilever from the ladder 42. The ladder 42 has a plurality of attachment features 52 allowing the arms 44 to be placed at various heights. The arm 44 extends forwardly from the rear portion 48 located at a back of fresh-food compartment 24 to a front portion 54 located at the front of the fresh-food compartment 24. The arm 44 includes a planar top surface 56 that generally extends between the rear portion 48 and the front portion 54.

Each shelf assembly 46 may further include a pair of half shelves 58 and 60 supported by a common one of the central arms 44. In the illustrated embodiment, the half shelf 58 includes a pane 62, e.g., glass, a rear support member or brace 64 and a front support member or brace (optional and not shown). The pane 62 includes an upper surface 63 configured to support food items and a lower surface 65. The rear support member 64 may be received on a rear edge 68 of the pane 62. The front support member (optional and not shown) may be received on a front edge 70 of the pane 62. The half shelf 60 may include a pane 72, e.g., glass, a rear support member or brace 74 and a front support member or brace (optional and not shown). The pane 72 includes an upper surface 73 configured to support food items and a lower surface 75. The rear support member 74 may be received on a rear edge 78 of the pane 62. The front support member may be received on a front edge 80 of the pane 72.

Each half shelf may be supported centrally by the arm 44 and on the outside by a support member of the liner 22. For example, the sidewall 32 of the liner 22 defines a support rail 110 configured to engage with the rear support 64. The support rail 110 may be an integrally formed feature of the liner 22 or maybe a standalone component that is attached to the liner 22. The support rail 110 projects outwardly from the sidewall 32 and includes a top and a bottom. The top may include a planar surface configured to engage with the bottom surface 65 of the pane 62. A second support rail (not visible) may be placed in front of the support rail 110 and is also configured to engage with the bottom surface 65 of the pane 62. The front support rail may be smaller than the rear support rail 110.

The rear support member 64 may have a connector 120 that is rotatably connectable to the support rail 110 such that the first shelf 58 is pivotal relative to the support rail 110. The connector 120 may include a planar portion configured to rest on the top of the support rail 110 and a hooked portion configured to partially extend around the rail 110. The planar portion 122 may include a plurality of ribs. The rear support 74 and the shelf 60 may be similarly supported and will not be discussed for brevity.

The arm 44 may have first and second opposing sidewalls 127, 129 that are spaced apart from each other such that the interior of the arm 44 is generally hollow. Each of the sidewalls 127, 129 may extend from the rear portion 48 to the tip 54 of the arm 44. The rear support 64 may be supported by the first sidewall 127 and the rear support 74 is supported by the second sidewall. The central arm 44 may define a rear cut out 131 in the top surface 56 allowing the rear supports 64, 74 to engage with the sidewalls 127, 129.

The shelf 58 may be installed by positioning the shelf 58 at an angle and aligning the pane 62 onto the front and rear support rails with the connector 120 of the rear bracket 64 received around the rear support rail 110. The shelf 58 is then pivoted downwardly until a connector of the rear support 64 engages with the central arm 44. The lower side 65 of the pane 62 is supported by the upper surface 56 of the arm 44. For brevity, only the connections for the shelf 58 are described. However, it is to be understood that the other shelves may be supported within the refrigerator appliance 20 in a similar or same manner. Only one shelve assembly 46 is shown, however, it is to be understood that the ladder 42 can support a plurality of shelve assemblies 46 that are arranged vertically relative to each other.

Referring to FIGS. 2 and 3, the ladder 42 may include a pair of opposing first and second sidewalls 150, 152 spaced from each other. A web 154 (a back wall) extends from the first sidewall 150 to the second sidewall 152 to join the first and second side walls to each other. The sidewalls 150, 152 may be oriented substantially orthogonal to the web 154 creating a U-channel structural member. The ladder 42 may be an extrusion in one or more embodiments. (Herein "substantially orthogonal" mean within plus-or-minus five degrees of orthogonal.)

The connection features 52, e.g., openings, may be provided in the web 154 or at the corners of the web and sidewalls (as shown). In the illustrated embodiment, the openings 52 are arranged in pairs placed at a same vertical location as each other. This creates a first vertical column of openings 52*a* and the second column of openings 52*b*. The sidewalls 150 and 152 are spaced apart by a distance that is wider than the support arm 44 so that the attachment features 50, e.g., hooks, are receivable within the attachment features 52, e.g., openings) to connect the arm 44 to the support ladder 42.

Figure 4:
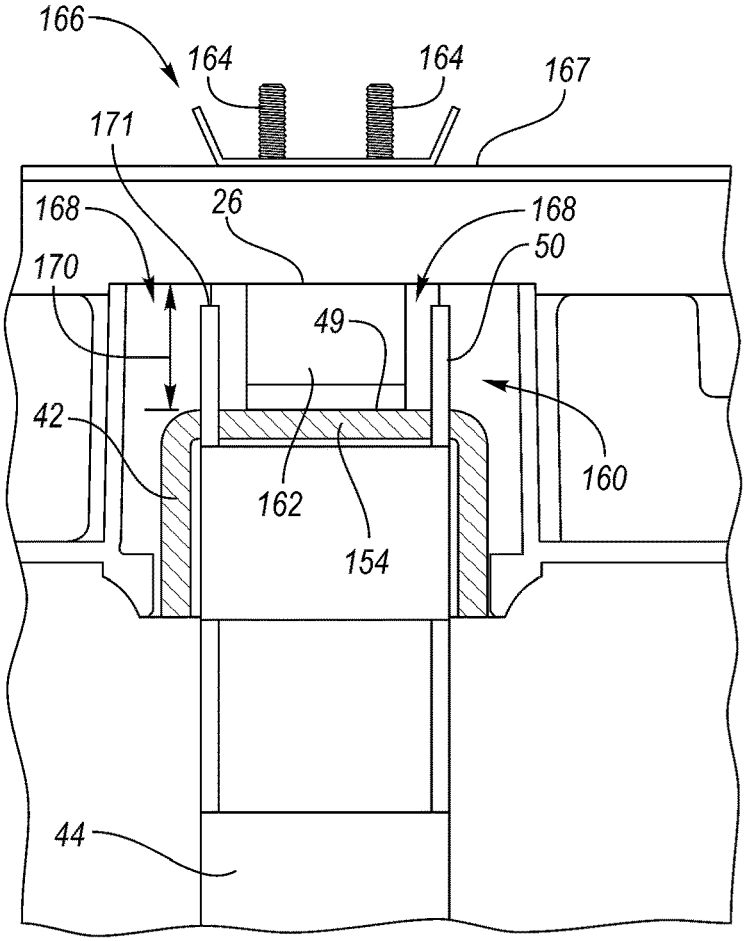
FIG. 4 is a partial top cross-sectional view of the refrigerator appliance.
Figure 5:
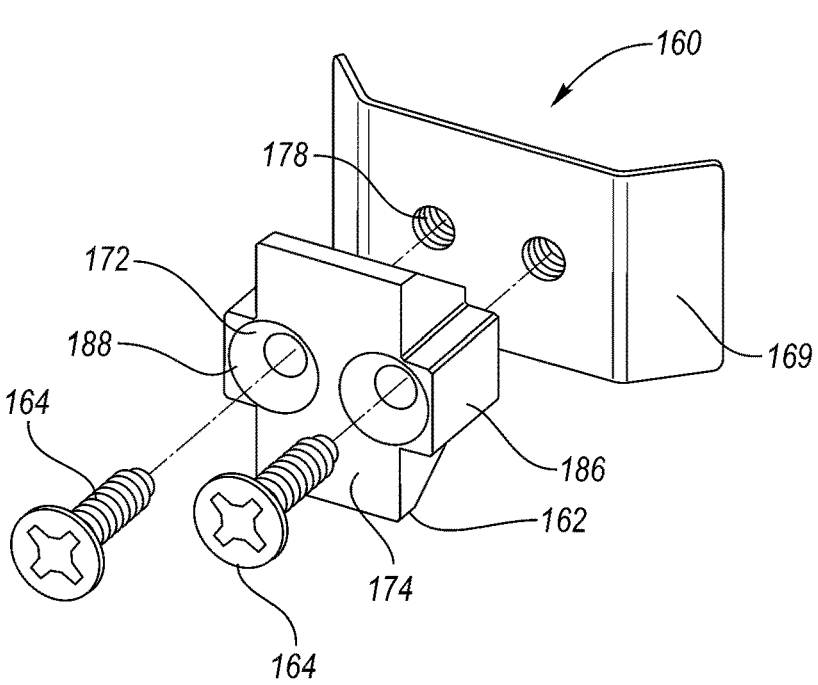
FIG. 5 is an exploded perspective view a fastener assembly.
Figure 6:
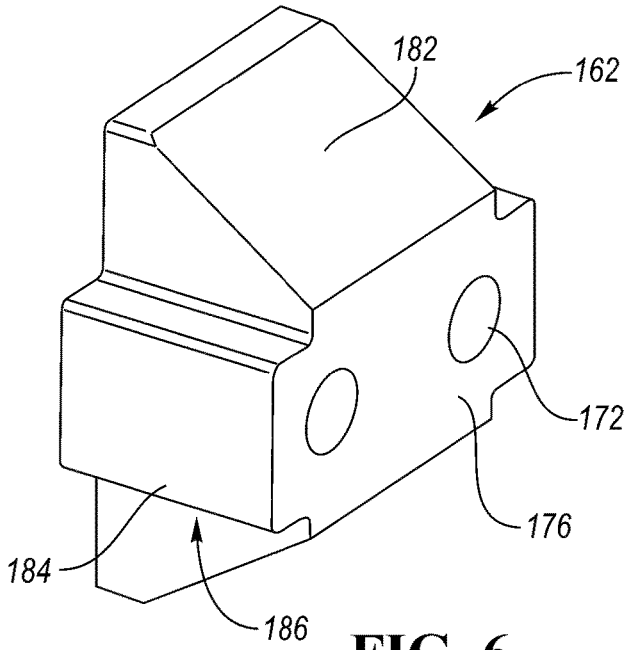
FIG. 6 is a perspective view of a spacer of the fastener assembly.

Referring to FIGS. 4-6, the hooks 50 (or other type of attachment feature) extend completely through the thickness of the web 154 resulting in protrusion of the hooks 50 past a rear face 49 of the web. To provide clearance for this, the ladder 42 is spaced apart from the back wall 26 of the liner. This clearance may be provided by a fastener assembly 160. The fastener assembly 160 may include a spacer 162, one or more fasteners 164, and an anchor 166 defining a hole(s) each configured to threadably engage with a fastener 164. The spacer 162 ensures a pocket 168 is maintained between the backside 49 of the web 154 and the back wall 26 of the liner 24. The thickness 170 of the spacer 162 is greater than a projecting length of the attachment features 50 to ensure that the tips 171 of the attachment features do not contact to the back wall 26 of the liner 22.

In the illustrated embodiment, the fastener assembly 160 includes a pair of fasteners 164, e.g., screws, that are received in a pair of side-by-side holes 172 each extending from a front face 174 of the spacer 162 to a rear face 176. The front face 174 is disposed against a backside 49 of the web 154 and the rear face 176 is disposed against the back wall 26 of the liner. The anchor 166 also defines a pair of holes 178 each associated with one of the fasteners 164. The holes 178 may be threaded. The anchor 166 is disposed on an exterior side 167 of the liner 22 outside of the fresh-food compartment 24. The ladder 42 defines fastener holes 180 that received the fasteners 164.

In one example, the ladder 42 is secured to the back wall 26 of the liner utilizing two fastener assemblies 160 with one placed at the top of the ladder 42 and another placed at the bottom of the ladder 42. In the illustrated example, a pair of fastener holes 180 are provided at the top of the ladder 42 for the upper fastener assembly and a pair of holes 180 are provided at the bottom of the ladder for the lower fastener assembly. The fasteners 164 extend through the holes 180 of the ladder 42, through the holes 172 of the spacer 162, through holes formed in the liner 22, and is secured to the anchor 166. The anchor 166 may include wings or flanges 169 extending from opposing sides. The wings 169 may increase the rigidity of the anchor in the interior of the polyurethane insulation.

The spacer 162 may have a tapered shape in which the front side 174 has a greater surface area than the backside 176. For example, angled walls 182 may be formed on the top and bottom. The sidewalls 184 may be straight. Bump outs 186 may be provided on the sidewalls 184 to accommodate the holes 172. The entrances 188 of the holes 172 may be conical to facilitate insertion of the fasteners 164. The spacer 162 may be sized to fit between the attachment features 50 of the arm 44. That is, a width of the spacer 162 is less than a width of at least the rear portion 48 of the arm 44.

Figure 7:
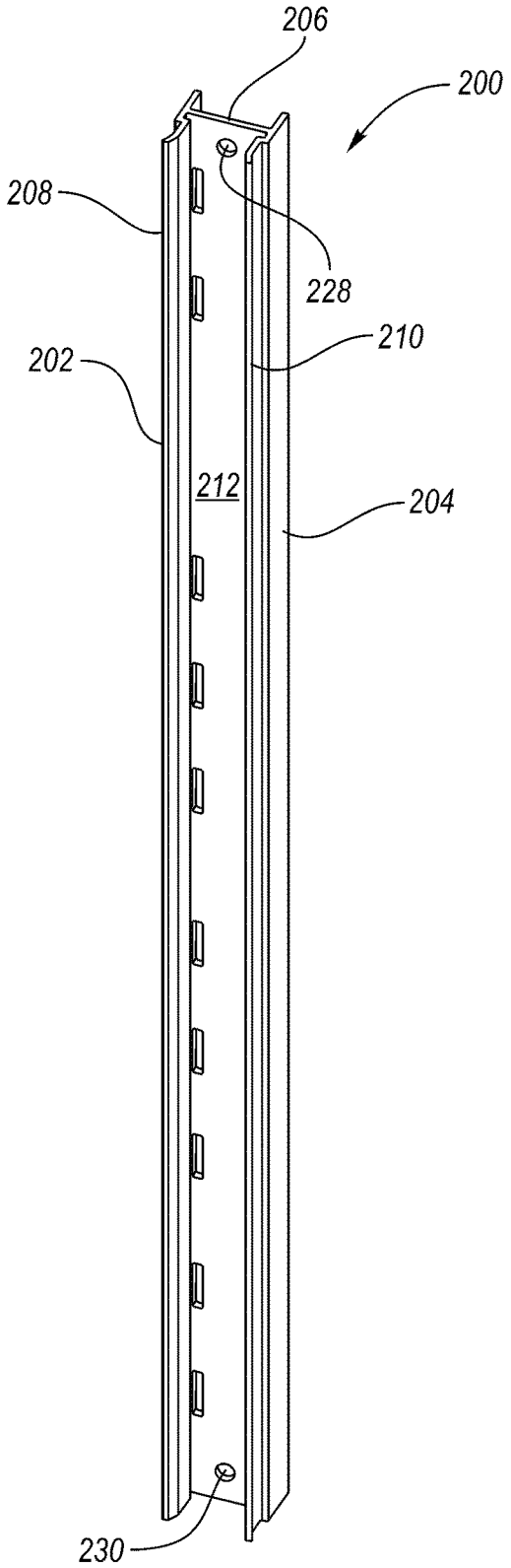
FIG. 7 is a perspective view of another support ladder of the shelving system.
Figure 8:
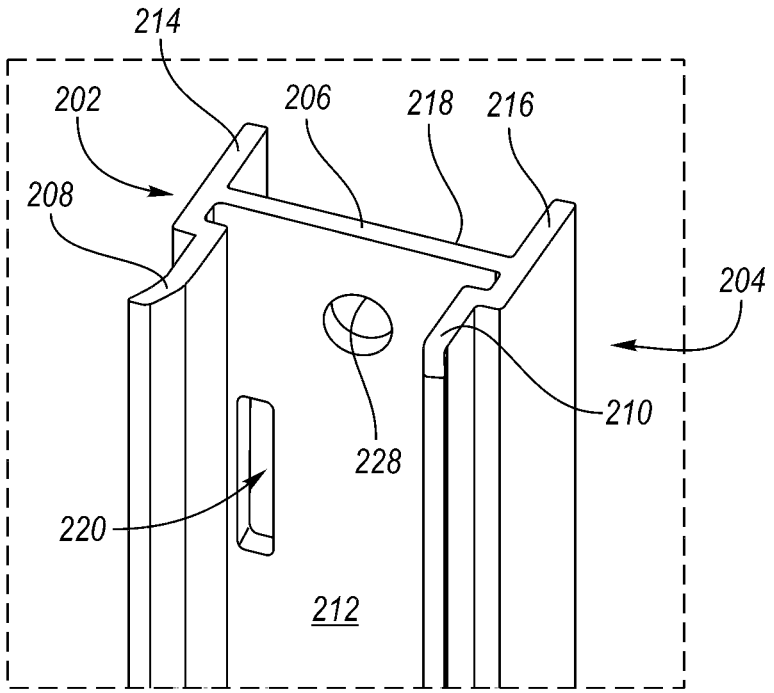
FIG. 8 is a detail view of a top portion of the another support ladder.
Figure 9:
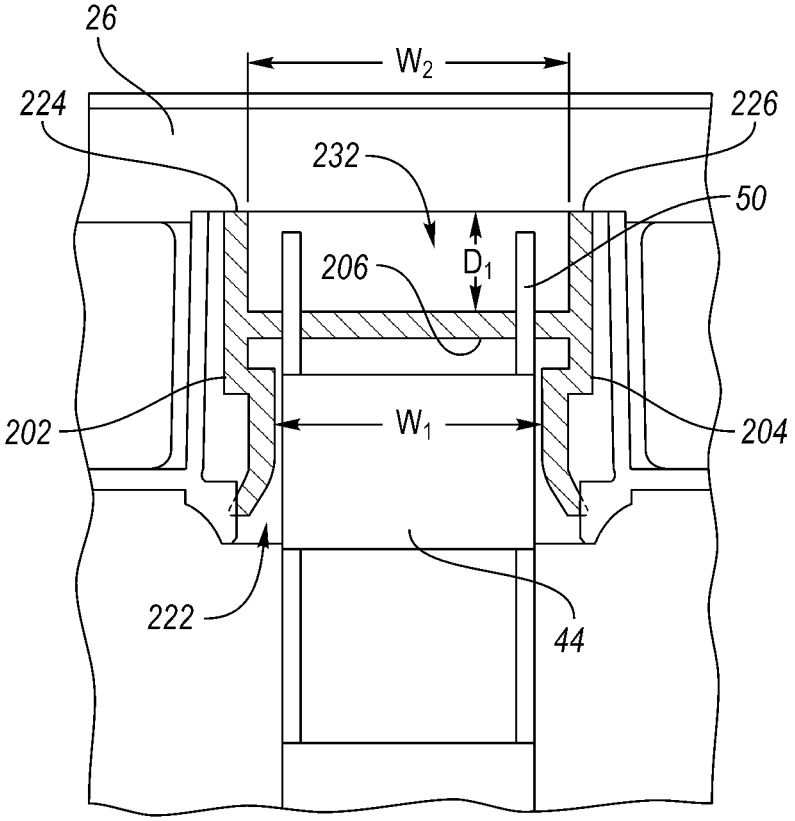
FIG. 9 is a partial top cross-sectional view of a refrigerator appliance with the another support ladder.

FIGS. 7-9 illustrate another elongate shelf-support ladder 200 that is self-spacing so that it can be attached to the liner 22 using simple fasteners or the like. The ladder 200 may be used instead of the ladder 42 in one or more embodiments. The ladder 200 may be attached to the back wall 26 of the liner 22 and received between the slots 38, 45 of the air duct 25 and the cover 36 as discussed above. The elongate shelf-support ladder 200 may include a pair of opposing first and second sidewalls 202, 204 spaced from each other. A web (or central transverse wall) 206 extends from the first sidewall 202 to the second sidewall 206 to join the first and second side walls to each other. The ladder 200 may have a generally H-shaped cross section. The sidewalls 202, 204 may be oriented substantially orthogonal to the web 206 such that front portions 208, 210 of the first and second sidewalls project from a front face 212 of the web 206 and such that rear portions 214, 216 of the first and second sidewalls project from a rear face 218 of the web 206. The ladder 200 may be extruded to form the above-described geometry. For example, the ladder 200 may be an aluminum extrusion.

Similar to the ladder 42, the ladder 200 defines openings 220 configured to receive the connection features 50, e.g., hooks, of the central arms 44. The openings 220 may be defined in the web 206 and extend completely through a thickness of the web. A width (W1) measured between the front portions 208, 210 of the sidewalls 202, 204 may be wider than a width of the support arm 44 so that the arm 44 can be received between the sidewalls 202, 204. The front portions 208 and 210 may flare away from each other to define a tapered entrance 222 to facilitate insertion of the arms 44. A width (W2) measured between the rear portions 214, 216 of the sidewalls may be wider than the width W1 of the front portions 208, 210.

The ladder 200 may be attached to the liner 24, with the rear tips 224, 226 of the sidewalls disposed against the back wall 26, using conventional fasteners, e.g., screws, that extend through mounting holes 228, 230 defined in the web 206. The rear portions 214, 216 of the sidewalls space the web 206 from the back wall 26 to form a pocket 232 that provides clearance for the attachment features 50 of the of the central arms. The ladder 200 may be sized and shaped such that a distance (D1) measured between a backside of the web 206 and an inside surface of the back wall 26 is greater than the projecting lengths of the attachments 50 of the arms. (A projecting length is the distance between the rear face of the web and the tip of the attachment feature.) This prevents the arms 44 from contacting the liner 22 when installed on the ladder 42.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A refrigerator appliance comprising:

a liner defining a compartment and including a back wall;

an air duct disposed against an interior side of the back wall and defining a first vertical slot;

a cover supported by and mounted to the back wall and disposed over the air duct, the cover defining a second vertical slot aligned with the first slot, wherein the ladder is received in the first slot and the second slot;

an elongate shelf-support ladder including a web having a first attachment feature, wherein the ladder is received in the first and second vertical slots and is attached to the back wall with the web spaced from the interior side, and the first attachment feature having a spacer disposed between the elongate shelf-support ladder and the interior side of the back wall, an anchor on an exterior side of the back wall, and a fastener extending through the elongate shelf-support ladder, the spacer, and the anchor, and wherein the spacer is received in the first vertical slot and the second vertical slot;

a shelf-support arm having a second attachment feature attached to the first attachment feature of the web such that the arm cantilevers from a front face of the web, wherein a portion of the second attachment feature extends through the web and is received in a space defined between the web and the interior side; and a shelf supported by the arm.

2. The refrigerator of claim 1, wherein the ladder includes first and second sides extending forwardly from the web, wherein the arm is disposed between the first and second sides.

3. The refrigerator of claim 2, wherein first and second sides flare away from each other to define a tapered entrance.

4. The refrigerator of claim 2, wherein the first and second sides extend rearwardly from the web to engage with the interior side of the back wall.

5. The refrigerator of claim 4, wherein a width between the first and second sides is wider on a rear side of the web than on a front side of the web.

6. The refrigerator of claim 1, wherein the comprising a-spacer disposed between the web and the interior side of the back wall.

7. The refrigerator of claim 1, wherein the first attachment feature is an opening and the second attachment feature is a hook receivable through the opening.

8. A refrigerator appliance comprising:

a liner including a back wall having interior and exterior sides; and a shelving system including:

an elongate shelf-support ladder, a fastener assembly attaching the ladder to the back wall, the fastening assembly having (i) a spacer disposed between the ladder and the interior side of the back wall, (ii) an anchor on the exterior side of the back wall, and (iii) a fastener extending through the ladder, the spacer, the liner, and the anchor;

an air duct disposed against the interior side of the back wall and defining a first slot; and a cover mounted on the back wall and disposed over the air duct, the cover defining a second slot aligned with the first slot, wherein the ladder is received in the first and second slots.

9. The refrigerator of claim 8, wherein the shelving system further includes:

a central arm having a rear portion attached to the ladder such that the arm is cantilevered from the ladder, and a shelf supported by the central arm.

10. The refrigerator of claim 9, wherein the ladder defines holes that receive attachments of the rear portion therein such that the attachments extend from a back side of the ladder towards the back wall, and wherein the spacer is disposed between the attachments.

11. The refrigerator of claim 10, wherein the attachments are hooks.

12. The refrigerator of claim 10, wherein a thickness of the spacer is greater than projecting lengths of the attachments so that tips of the attachments are spaced from the interior side of the back wall.

13. The refrigerator of claim 8, wherein the spacer defines a pair of side-by-side fastener holes, and the fastener is a pair of fasteners extending through the fastener holes.

14. The refrigerator of claim 8, wherein the spacer has a first side disposed against the ladder and a second side disposed against the back wall, wherein a surface area of the first side is larger than a surface area of the second side.

15. The refrigerator of claim 8, wherein the anchor has a main portion disposed against the back wall and a pair of wings extending from the main portion at an angle away from the back wall.

16. A refrigerator appliance comprising:

a liner including a back wall;

an elongate shelf-support ladder including:

a pair of opposing first and second sidewalls spaced from each other, and a web extending from the first sidewall to the second sidewall to connect the first sidewall and the second sidewall to each other, the sidewalls being oriented substantially orthogonal to the web such that front portions of the first sidewall and the second sidewalls projects from a front face of the web and such that rear portions of the first sidewall and the second sidewall projects from a rear face of the web, wherein the ladder is attached to the liner with the rear portions disposed against the back wall to define a pocket bounded by the liner, the first sidewall, the second sidewall, and the web;

a shelf-support arm disposed between the first sidewall and the second sidewalls and connected to the web such that the arm cantilevers from the front face, wherein a portion of the arm extends through the web and is received in the pocket;

an air duct disposed against an interior side of the back wall and defining a first slot;

a cover mounted on the back wall and disposed over the air duct, the cover defining a second slot aligned with the first slot, wherein the elongate shelf-support ladder is received in the first and second slots;

a spacer disposed between the elongate shelf-support ladder and the interior side of the back wall; and a shelf supported by the arm.

17. The refrigerator of claim 16, wherein the front portions of the first sidewall and second sidewall flares away from each other to define an entrance having a width that is wider than a width of the arm.

18. The refrigerator of claim 16, wherein a distance between the front portions is less than a distance between the rear portions.

* * * * *